US008679621B2

(12) United States Patent
Blaiszik et al.

(10) Patent No.: US 8,679,621 B2
(45) Date of Patent: Mar. 25, 2014

(54) MATERIALS AND METHODS FOR AUTONOMOUS RESTORATION OF ELECTRICAL CONDUCTIVITY

(75) Inventors: Benjamin J. Blaiszik, Urbana, IL (US); Susan A. Odom, Champaign, IL (US); Mary M. Caruso, Urbana, IL (US); Aaron C. Jackson, Urbana, IL (US); Marta B. Baginska, Urbana, IL (US); Joshua A. Ritchey, Cambridge, MA (US); Aaron D. Finke, Urbana, IL (US); Scott R. White, Champaign, IL (US); Jeffrey S. Moore, Savoy, IL (US); Nancy R. Sottos, Champaign, IL (US); Paul V. Braun, Savoy, IL (US); Khalil Amine, Oak Brook, IL (US)

(73) Assignee: Board of Trustees of the University of Illinois, Urbana, IL (US)

( * ) Notice: Subject to any disclaimer, the term of this patent is extended or adjusted under 35 U.S.C. 154(b) by 221 days.

(21) Appl. No.: 13/164,144

(22) Filed: Jun. 20, 2011

(65) Prior Publication Data

US 2012/0067615 A1 Mar. 22, 2012

Related U.S. Application Data

(60) Provisional application No. 61/356,356, filed on Jun. 18, 2010.

(51) Int. Cl.
*H01B 3/30* (2006.01)

(52) U.S. Cl.
USPC ..... 428/321.5

(58) Field of Classification Search
None
See application file for complete search history.

(56) References Cited

U.S. PATENT DOCUMENTS

| | | | | |
|---|---|---|---|---|
| 2005/0250878 | A1* | 11/2005 | Moore et al. | 523/211 |
| 2006/0155134 | A1* | 7/2006 | Werner et al. | 549/86 |
| 2010/0122832 | A1* | 5/2010 | Bukshpun et al. | 174/110 R |
| 2011/0033721 | A1* | 2/2011 | Rohatgi | 428/548 |

OTHER PUBLICATIONS

"Restoration of Conductivity with TTF-TCNQ Charge-Transfer Salts," Odom et al., Advanced Functional Materials, 2010, 20, 1721-1727.*

"Using nanoparticles to create self-healing composites," Balazs et al., J. Chem. Phys. 121, 5531, 2004.*

* cited by examiner

*Primary Examiner* — Mark Ruthkosky
*Assistant Examiner* — Ian Rummel
(74) *Attorney, Agent, or Firm* — Blanchard & Associates

(57) ABSTRACT

An autonomic conductivity restoration system includes a solid conductor and a plurality of particles. The particles include a conductive fluid, a plurality of conductive micro-particles, and/or a conductive material forming agent. The solid conductor has a first end, a second end, and a first conductivity between the first and second ends. When a crack forms between the first and second ends of the conductor, the contents of at least a portion of the particles are released into the crack. The cracked conductor and the released contents of the particles form a restored conductor having a second conductivity, which may be at least 90% of the first conductivity.

20 Claims, 9 Drawing Sheets

MATERIALS AND METHODS FOR AUTONOMOUS RESTORATION OF ELECTRICAL CONDUCTIVITY

REFERENCE TO RELATED APPLICATIONS

This application claims the benefit of U.S. Provisional Application No. 61/356,356 entitled "Method and Apparatus for Autonomic Repair and Restoration of Electrical Conductivity" filed Jun. 18, 2010, which is incorporated by reference in its entirety.

FEDERALLY SPONSORED RESEARCH OR DEVELOPMENT

This invention was made with government support under contract number(s) ANL 9F 31921 and 392 NSF CHE 09-36888 FLLW ARRA awarded by the Department of Energy and the National Science Foundation ACC Fellowship. The government has certain rights in the invention.

BACKGROUND

The demand for smaller electronics with increased performance and functionality has driven the development of complex, high-density integrated circuits and robust packaging that operate in adverse environments. Scaling of planar integrated circuits (ICs) has resulted in devices with large numbers of thin, patterned conductive films (typically Cu or Al) separated by dielectric layers and interconnected through multiple levels of conductive vias. Recent advances in 3D integration and flexible circuitry have further enhanced performance and functionality of electronic circuits.

As integration and packaging of microelectronic devices has become more complex, the multiscale and dissimilar nature of the constituent materials has led to reliability issues that impair electrical performance of the entire system. Failure of interconnects and conductive pathways due to thermomechanical stress remains a long-standing problem hindering advanced packaging. Loss of conductivity in electronic circuits can occur through mechanisms such as interconnect fracture, conductive pathway delamination, and thin film cracking. These circuit failures degrade functionality, requiring costly replacement of the entire component.

Efforts to restore failures within electronic circuits have focused on two different aspects. In the materials aspect, restoration of conductivity has been investigated using external intervention, in the form of heating or of manual delivery of relatively low conductivity materials to the failure site. In the electronic aspect, self-healing circuits have been investigated using hardware redundancy or delay-insensitive asynchronous logic. These conventional approaches to conductivity restoration in electronic circuits have met with mixed success.

It is desirable to provide a system that autonomously restores conductivity to failed electronic circuit elements such as interconnects and conductive pathways. Preferably such a system would not require control software or manual intervention, and would not impair normal operation of the electronic circuit.

SUMMARY

In one aspect, the invention provides an autonomic conductivity restoration system that includes a solid conductor, a solid polymer matrix on the conductor, and a plurality of capsules in the matrix. The capsules include a conductive fluid. The solid conductor has a first end, a second end, and a first conductivity between the first and second ends. When a crack forms between the first and second ends of the conductor and in the matrix, at least a portion of the capsules is ruptured, and the conductive fluid contacts the conductor and forms a restored conductor having a second conductivity that is at least 90% of the first conductivity.

In another aspect of the invention, there is an autonomic conductivity restoration system that includes a solid conductor, a solid polymer matrix on the conductor, and a plurality of particles in the matrix. The particles include a plurality of conductive microparticles. The solid conductor has a first end, a second end, and a first conductivity between the first and second ends. When a crack forms between the first and second ends of the conductor and in the matrix, at least a portion of the conductive microparticles is released, and the released conductive microparticles contact the conductor and form a restored conductor having a second conductivity that is at least 90% of the first conductivity.

In another aspect of the invention, there is an autonomic conductivity restoration system that includes a solid conductor, a solid polymer matrix on the conductor, and a plurality of particles in the matrix. The particles include a conductive material forming agent. The solid conductor has a first end, a second end, and a first conductivity between the first and second ends. When a crack forms between the first and second ends of the conductor and in the matrix, at least a portion of the conductive material forming agent is released, and the released conductive material forming agent contacts the conductor and forms a restored conductor having a second conductivity that is at least 90% of the first conductivity.

To provide a clear and more consistent understanding of the specification and claims of this application, the following definitions are provided.

The term "polymer" means a substance containing more than 100 repeat units. The term "polymer" includes soluble and/or fusible molecules having long chains of repeat units, and also includes insoluble and infusible networks. The term "prepolymer" means a substance containing less than 100 repeat units and that can undergo further reaction to form a polymer.

The term "matrix" means a continuous phase in a material.

The term "capsule" means a hollow, closed object having an aspect ratio of 1:1 to 1:10, and that may contain a solid, liquid, gas, or combinations thereof. The aspect ratio of an object is the ratio of the shortest axis to the longest axis, where these axes need not be perpendicular. A capsule may have any shape that falls within this aspect ratio, such as a sphere, a toroid, or an irregular ameboid shape. The surface of a capsule may have any texture, for example rough or smooth.

The term "encapsulant" means a material that will dissolve or swell in a polymerizer and, when combined with an activator, will protect the activator from reaction with materials used to form a solid polymer matrix. A corresponding encapsulant for a solid polymer matrix and for a polymerizer will protect an activator from reaction with materials used to form that specific solid polymer matrix and will dissolve or swell in that specific polymerizer.

BRIEF DESCRIPTION OF THE DRAWINGS

The invention can be better understood with reference to the following drawings and description. The components in the figures are not necessarily to scale and are not intended to accurately represent molecules or their interactions, emphasis instead being placed upon illustrating the principles of the invention. Moreover, in the figures, like referenced numerals designate corresponding parts throughout the different views.

DETAILED DESCRIPTION

An autonomic conductivity restoration system includes a solid conductor and a plurality of particles. The solid conductor has a first end, a second end, and a first conductivity between the first and second ends. The particles include a conductive fluid, a plurality of conductive microparticles, and/or a conductive material forming agent. When a crack forms between the first and second ends of the conductor, the contents of at least a portion of the particles are released into the crack. The cracked conductor and the released contents of the particles form a restored conductor having a second conductivity. Preferably the second conductivity is at least 90% of the first conductivity.

The autonomic conductivity restoration system can be configured to provide nearly full recovery of conductivity (~99%) following the formation of a crack in an electronic circuit element, and to do so on the millisecond time scale without external intervention. This autonomic conductivity restoration has the potential to create more sustainable electronic devices through increased fault-tolerance, improved circuit reliability, and extended service life in even the most challenging mechanical environments. Self-healing circuits incorporating the autonomic conductivity restoration system could provide increased longevity and device reliability in adverse mechanical environments, enabling new applications in microelectronics, advanced batteries, and electrical systems.

Figure 1A:
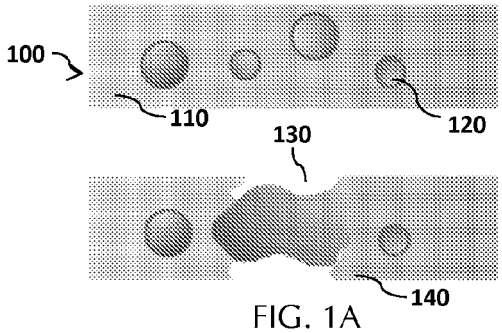
FIGS. 1A-1C depict schematic representations of autonomic conductivity restoration systems.

FIG. 1A is a schematic representation of an autonomic conductivity restoration system 100 that includes a solid conductor 110 and a plurality of particles 120 containing a conductive fluid. When a crack 130 forms in the conductor, at least a portion of the particles is ruptured, releasing their contents to the crack. The cracked conductor and the released contents of the particles form a restored conductor 140.

Figure 1B:
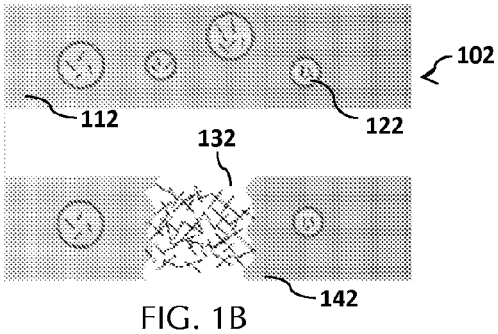

FIG. 1B is a schematic representation of an autonomic conductivity restoration system 102 that includes a solid conductor 112 and a plurality of particles 122 containing a plurality of conductive microparticles. When a crack 132 forms in the conductor, the conductive microparticles are released into the crack. The cracked conductor and the released conductive microparticles form a restored conductor 142.

Figure 1C:
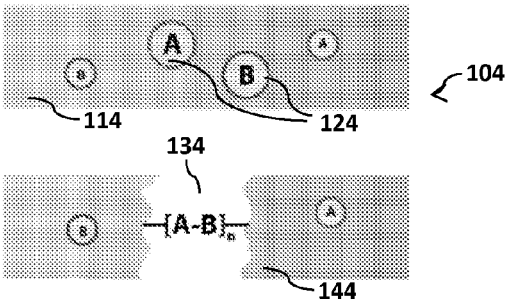

FIG. 1C is a schematic representation of an autonomic conductivity restoration system 104 that includes a solid conductor 114 and a plurality of particles 124 containing a conductive material forming agent. When a crack 134 forms in the conductor, the conductive material forming agent is released into the crack, forming a conductive material. The cracked conductor and the conductive material form a restored conductor 144.

The solid conductor (110, 112 or 114) may be any electrically conductive solid material. Examples of electrically conductive solid materials include metals such as aluminum, titanium, chromium, manganese, iron, cobalt, nickel, copper, zinc, silver, tungsten, platinum, gold and mixtures of these; and non-metals such as carbon and conducting polymers. A solid conductor can be characterized by its electrical conductivity, which is the ability to conduct electricity between two points on the conductor. For the conductors depicted in FIG. 1, the conductivity may be measured between a first end and a second end located at or near opposite ends of the length of the conductor.

The particles (120, 122 or 124) may be capsules having a capsule wall enclosing an interior volume that contains a conductive liquid, conductive microparticles, and/or a conductive material forming agent. A capsule isolates the contents of its interior volume until the system is subjected to damage that forms a crack in the conductor. Once the damage occurs, a capsule in contact with the damaged area can rupture, releasing its contents at the site of the crack in the conductor.

The capsules have an aspect ratio of from 1:1 to 1:10, preferably from 1:1 to 1:5, from 1:1 to 1:3, from 1:1 to 1:2, or from 1:1 to 1:1.5. In one example, the capsules may have an average diameter of from 10 nanometers (nm) to 1 millimeter (mm), more preferably from 30 to 500 micrometers, and more preferably from 50 to 300 micrometers. In another example, the capsules may have an average diameter less than 10 micrometers. Capsules having an average outer diameter less than 10 micrometers, and methods for making these capsules, are disclosed, for example, in U.S. Patent Application Publication 2008/0299391 with inventors White et al., published Dec. 4, 2008.

The thickness of the capsule wall may be, for example, from 30 nm to 10 micrometers. For capsules having an average diameter less than 10 micrometers, the thickness of the capsule wall may be from 30 nm to 150 nm, or from 50 nm to 90 nm. The selection of capsule wall thickness may depend on a variety of parameters, such as the nature of the solid polymer matrix, and the conditions for making and using the material. For example, a capsule wall that is too thick may not rupture when the interface with which it is in contact is damaged, while a capsules wall that is too thin may break during processing.

Capsules may be made by a variety of techniques, and from a variety of materials. Examples of materials from which the capsules may be made, and the techniques for making them include: polyurethane, formed by the reaction of isocyanates with a diol or triol; urea-formaldehyde (UF), formed by in situ polymerization; gelatin, formed by complex coacervation; polystyrene, formed by complex coacervation; polyurea, formed by the reaction of isocyanates with a diamine or a triamine, depending on the degree of crosslinking and brittleness desired; polystyrene or polydivinylbenzene formed by addition polymerization; and polyamide, formed by the use of a suitable acid chloride and a water soluble triamine. For capsules having an average diameter less than 10 micrometers, the capsule formation may include forming a microemulsion containing the capsule starting materials, and forming microcapsules from this microemulsion.

The particles (122 or 124) may be solid particles containing conductive microparticles, and/or a conductive material forming agent embedded in an encapsulant material. A particle isolates the conductive microparticles or conductive material forming agent until the system is subjected to damage that forms a crack in the conductor. Once the damage occurs, the conductive microparticles or conductive material forming agent can be released into the crack in the conductor.

The particles may have an aspect ratio of from 1:1 to 1:10, preferably from 1:1 to 1:5, from 1:1 to 1:3, from 1:1 to 1:2, or from 1:1 to 1:1.5. In one example, the particles may have an average diameter of from 10 nanometers (nm) to 1 millimeter (mm), more preferably from 30 to 500 micrometers, and more preferably from 50 to 300 micrometers. In another example, the particles may have an average diameter less than 10 micrometers.

The restored conductor (140, 142 or 144) is a combination of the original solid conductor that has been subjected to a crack, and the contents of the ruptured capsules that traverse the crack. A restored conductor can be characterized by its electrical conductivity, which is the ability to conduct electricity between two points on the restored conductor. For the restored conductors depicted in FIG. 1, the conductivity may be measured between a first end and a second end located at or near opposite ends of the length of the restored conductor. Preferably the conductivity of the restored conductor is measured between points identical to those used in measuring the conductivity of the original solid conductor.

In one example (i.e. FIG. 1A), an autonomic conductivity restoration system includes a solid conductor, a solid polymer matrix on the conductor, and a plurality of capsules in the matrix. The solid conductor has a first end, a second end, and a first conductivity between the first and second ends. The capsules include a conductive fluid. When a crack forms between the first and second ends of the conductor and in the matrix, at least a portion of the capsules is ruptured. The conductive fluid contacts the conductor and forms a restored conductor having a second conductivity that is at least 90% of the first conductivity.

The solid polymer matrix may be any polymer, and preferably is an electrically insulating material or is a dielectric material. Examples of polymers that can be included in the solid polymer matrix include a polyamide such as nylon; a polyester such as poly(ethylene terephthalate) and polycaprolactone; a polycarbonate; a polyether; an epoxy polymer; an epoxy vinyl ester polymer; a polyimide such as polypyromellitimide (for example KAPTAN); a phenol-formaldehyde polymer such as BAKELITE; an amine-formaldehyde polymer such as a melamine polymer; a polysulfone; a poly(acrylonitrile-butadiene-styrene) (ABS); a polyurethane; a polyolefin such as polyethylene, polystyrene, polyacrylonitrile, a polyvinyl, polyvinyl chloride and poly (DCPD); a polyacrylate such as poly(ethyl acrylate); a poly(alkylacrylate) such as poly(methyl methacrylate); a polysilane such as poly(carborane-siloxane); and a polyphosphazene. The solid polymer matrix may include an elastomer, such as an elastomeric polymer, an elastomeric copolymer, an elastomeric block copolymer, and an elastomeric polymer blend. Self-healing materials that include an elastomer as the solid polymer matrix are disclosed, for example, in U.S. Pat. No. 7,569,625 to Keller et al. The solid polymer matrix may include a mixture of these polymers, including copolymers that include repeating units of two or more of these polymers, and/or including blends of two or more of these polymers.

The solid polymer matrix may include other ingredients in addition to the polymeric material. For example, the matrix may contain one or more particulate fillers, reinforcing fibers, stabilizers, antioxidants, flame retardants, plasticizers, colorants and dyes, fragrances, or adhesion promoters. An adhesion promoter is a substance that increases the adhesion between two substances, such as the adhesion between two polymers. One type of adhesion promoter that may be present includes substances that promote adhesion between the solid polymer matrix and the capsules, and/or between the solid polymer matrix and the particles. The adhesion between the matrix and the capsules may influence whether the capsules will rupture or debond when a crack is formed in the matrix. To promote one or both of these forms of adhesion, various silane coupling agents may be used. Another type of adhesion promoter that may be present includes substances that promote adhesion between the solid polymer matrix and a polymer that may be formed in the crack, such as a polymer formed from a polymerizer and activator present in the system. The adhesion between the matrix and this polymer may influence whether the material can be healed once damage has occurred. To promote the adhesion between the solid polymer matrix and the polymer formed in the crack, various unsaturated silane coupling agents may be used.

The conductive fluid may be any fluid that is an electrical conductor. Examples of conductive fluids include metals that are liquids at 25° C., such as gallium and mercury; and metal mixture that are liquids at 25° C., such as mixtures of two or more of gallium, indium, tin, lead, bismuth, cadmium, mercury, antimony, silver, copper, and gold. Examples of conductive fluids include ionic liquids that are liquids at 25° C., such as salts of acetocholine, alanine, aminoacetonitrile, methylammonium, arginine, aspartic acid, threonine, chloroformamidinium, thiouronium, quinolinium, pyrrolidinol, serinol, benzamidine, sulfamate, acetate, carbamates, triflates, and cyanides.

The capsules that contain the conductive fluid may be made by combining an oil phase and an aqueous phase to form an emulsion, where the aqueous phase includes a polymerizer. The conductive fluid is then added to the emulsion, and the polymerization is carried out in the aqueous phase to form capsule walls enclosing the oil phase droplets containing the conductive fluid.

Referring to FIG. 1A, the second conductivity of the restored conductor 140 preferably is at least 90% of the first conductivity of the solid conductor 110. More preferably the second conductivity is at least 95% of the first conductivity, more preferably is at least 97% of the first conductivity, more preferably is at least 98% of the first conductivity, and more preferably is at least 99% of the first conductivity.

Figure 2:
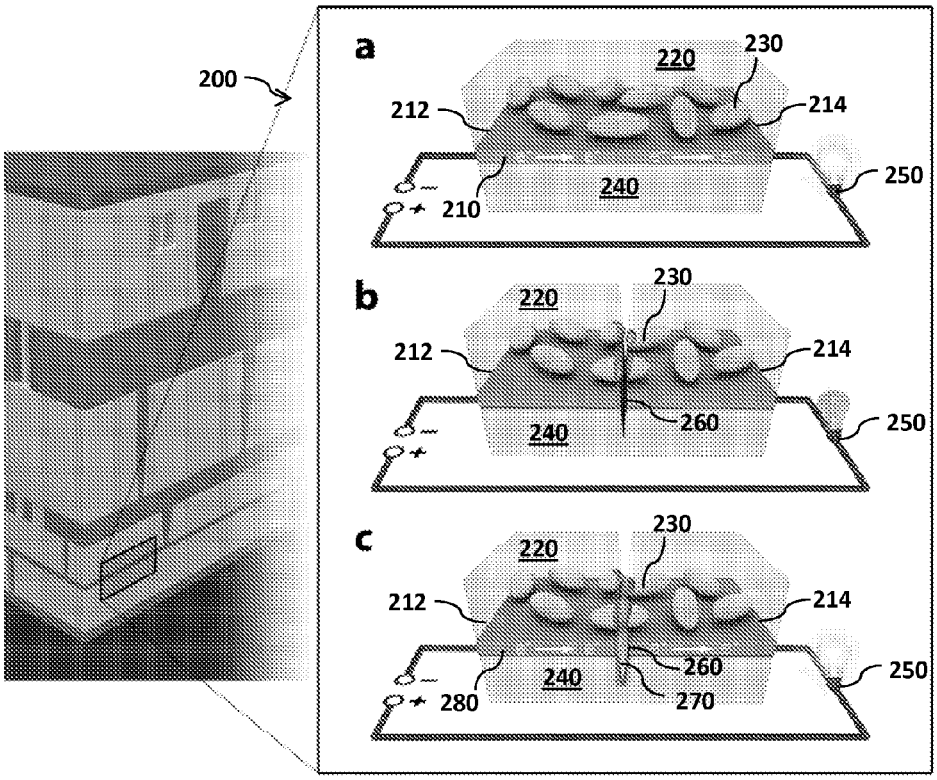
FIGS. 2A-2C depict a series of schematic representations of an autonomic conductivity restoration system

FIG. 2A-2C is a series of schematic representations of an autonomic conductivity restoration system 200. In FIG. 2A, system 200 includes a solid conductor 210, a solid polymer matrix 220 on the conductor, and a plurality of capsules 230 in the matrix. The solid conductor 210 has a first end 212 and a second end 214, and may be on a substrate 240. When an electric potential is applied between the first and second ends, an electric current flows in the conductor, which has a first conductivity. This electric current can provide electric power to an optional electric device 250.

FIG. 2B is a schematic representation of the autonomic conductivity restoration system 200 after the solid conductor has been damaged by a crack 260 between the first end 212 and the second end 214 of the conductor. Certain of the capsules 230 have ruptured, and their contents may now be released into the crack 260. As the crack is a physical discontinuity in the solid conductor, electric current can no longer flow between the first and second ends of the damaged conductor. Accordingly, an optional electric device 250 in communication with these ends will not have electric power.

FIG. 2C is a schematic representation of the autonomic conductivity restoration system 200 after the contents of the ruptured capsules 230 have been released and traverse the crack 260. The damaged solid conductor and the conductive material 270 formed from the contents of the ruptured capsules form a restored conductor 280. When an electric potential is applied between the first and second ends, an electric current once again flows in the restored conductor, which has a second conductivity. This electric current can provide electric power to the optional electric device 250.

Figure 3:
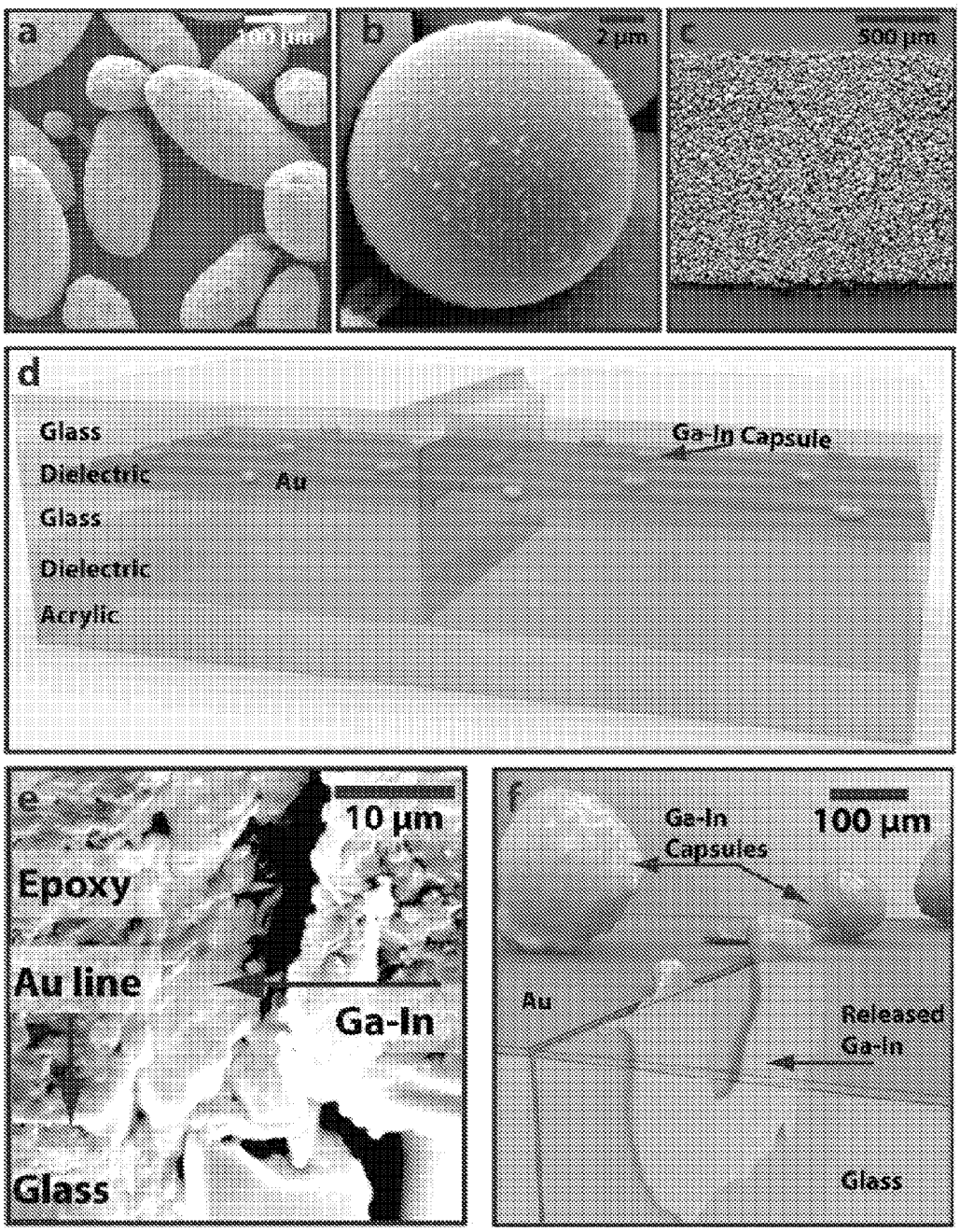
FIGS. 3A-3F depict images of various autonomic conductivity restoration system components.

In an autonomic conductivity restoration system based on an encapsulated conductive fluid, such as the system 200, restoration of conductivity may be accomplished by the release and transport of the conductive fluid to the site of damage. In one example, eutectic gallium-indium (Ga—In) alloy having a melting point of 16° C. and conductivity of $3.40\times10^4$ $S\cdot cm^{-1}$ was encapsulated in a polymeric (urea-formaldehyde) (UF) shell wall. FIG. 3A depicts a scanning electron micrograph (SEM) image of UF microcapsules containing Ga—In and having an average major axis of approximately 200 micrometers. FIG. 3B depicts a SEM image of UF microcapsules containing Ga—In and having an average major axis of approximately 10 micrometers. With a core of liquid Ga—In, the shell wall of the microcapsules was likely a combination of the urea-formaldehyde polymer and a metal oxide passivation layer that can readily form when Ga—In is in the presence of oxygen. Capsule size was controlled by varying the processing conditions (See Example 1, below). Through the use of sonication, capsules as small as 3 μm may be produced. Interestingly, as capsule diameter was reduced, the capsule shape became more spherical (FIG. 3B).

The performance of the microcapsules in a model multilayer device before and after mechanical damage was examined. A conductive circuit was formed by patterning Au lines on a rigid glass substrate. An epoxy dielectric layer was deposited on top of the conductive circuit. Larger diameter Ga—In microcapsules (~200 micrometers) were embedded in the dielectric layer, whereas smaller diameter microcapsules (~10 micrometers) were patterned directly onto the Au lines. FIG. 3C depicts a SEM image of the microcapsules of FIG. 3B patterned on an Au line.

The resulting device was bonded to a notched glass top layer and a ductile acrylic bottom layer, and then loaded in four-point bending to provide controlled and repeatable circuit failure. FIG. 3D is a schematic representation of a model multilayer test specimen including, from the bottom to the top, an acrylic bottom layer, a neat epoxy dielectric layer, a glass substrate layer, a Au line pattern having a thickness of 100 nm, an epoxy dielectric containing microcapsules filled with Ga—In, and a notched glass top layer.

During testing of a specimen according to FIG. 3D, crack damage initiated at the notch root and propagated through the specimen before arresting and/or debonding at the acrylic interface. At a critical bending load, a crack initiated at the notch root and propagated through the dielectric layer and conductive Au line, finally arresting at the bonded acrylic interface. The embedded microcapsules were ruptured during crack propagation releasing liquid metal into the damage circuit. Specimens were imaged using micro-CT and electron microscopy, revealing the localized release and transport of Ga—In alloy into the crack plane. FIG. 3E depicts a cross-sectional SEM image of a damaged test specimen, in which a conductive fluid had been released into a crack in a damaged Au line. FIG. 3F depicts a Micro-CT image combined with a schematic of a test specimen, in which liquid metal that has been released from a microcapsule into the crack plane of a test specimen.

The circuit was monitored throughout the four-point bend test using a Wheatstone Bridge circuit with the specimen as one bridge arm (See Example 5, below). The performance of the circuit was tracked by measuring the normalized bridge voltage, $V_{norm}=(V_h-V_\infty)/(V_o-V_\infty)$ where $V_o$ is the bridge voltage before damage, $V_\infty$ is the bridge voltage measured when after the circuit is broken, and $V_h$ is the instantaneous bridge voltage of the circuit. The value of $V_{norm}$ ranged from zero (0) for a specimen with no electrical conductance to one (1) for a fully conductive specimen. The efficiency of conductivity restoration, $\eta_c$, was defined for each specimen as $V_{norm}$ after fracture.

Figure 4:
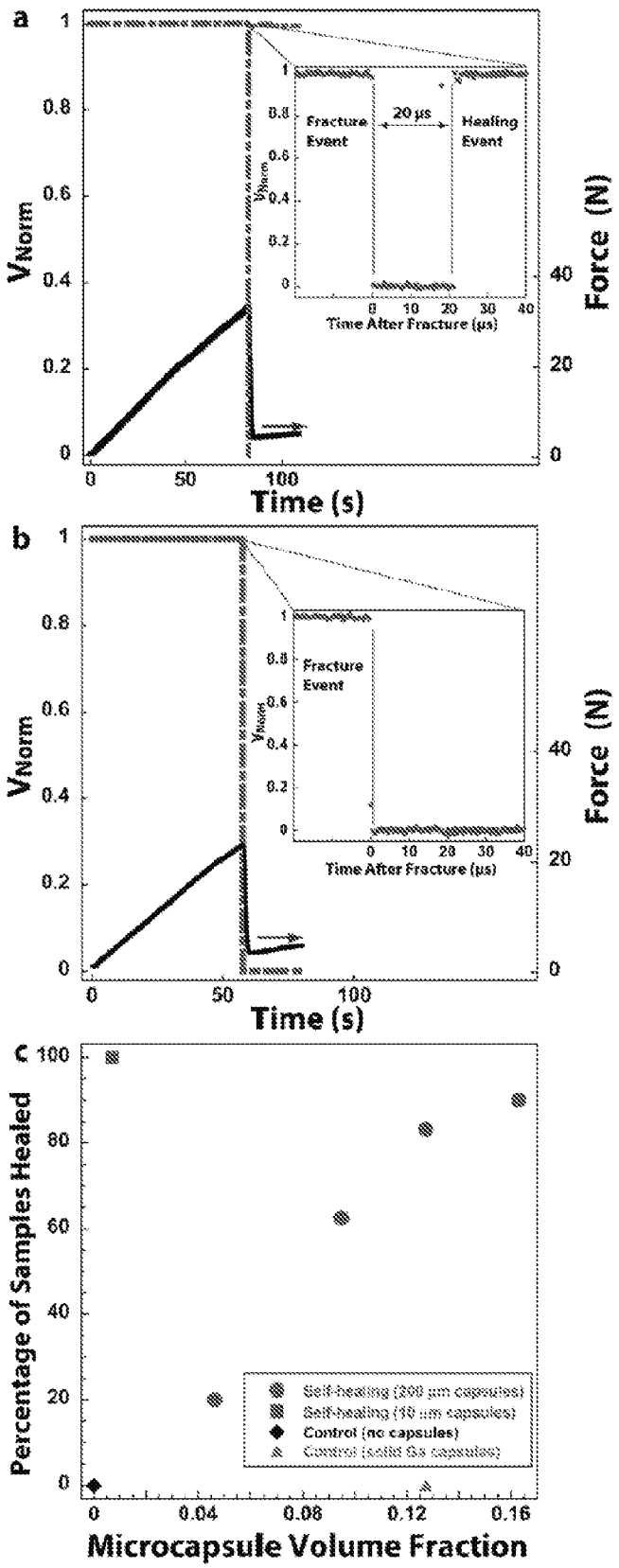
FIGS. 4A-4C depict representative mechanical and electrical responses for autonomous conductivity restoration specimens and for control specimens.

Representative mechanical and electrical responses for autonomous conductivity restoration samples and for control specimens are shown in FIG. 4. FIG. 4A depicts graphs of force (solid line) and normalized bridge voltage (dashed line) over time for autonomous conductivity restoration specimens. FIG. 4B depicts graphs of force (solid line) and normalized bridge voltage (dashed line) over time for a control specimen that contained no capsules. Each figure includes an enlarged plot of the normalized bridge voltage at the time of specimen fracture. The bending load increased linearly and then precipitously dropped when crack propagation occurred. The load reached a plateau as the crack arrested at the acrylic layer and a delamination propagated along the acrylic/epoxy interface. When fracture occurred, $V_{norm}$ simultaneously dropped to 0, correlating to a broken circuit (i.e. $V_h$ approaches $V_\infty$).

In FIG. 4A, for the autonomous conductivity restoration specimens $V_{norm}$ rapidly recovered to over 99% of the undamaged value ($\eta_c$>99%). The recovery of conductivity for these specimens occurred within 20 microseconds. Monitoring of the resistance between adjacent Au lines for these specimens detected no short circuits.

The normalized bridge voltage of a subset of specimens was monitored at a sampling rate of 1 MHz to investigate the time scale for recovery of conductivity ($t_{heal}$). For the autonomous specimen containing Ga—In capsules, the normalized bridge voltage quickly returned to $V_o$ after 485 μs. Healing time varied from sample to sample, from a minimum of 5 μs to a maximum on the order of several seconds. The shortest time for restoration of conductivity was approximately 8 orders of magnitude faster than the time required for recovery of fracture toughness in prior microcapsule-based self-healing. See, for example, White, S. et al. Autonomic healing of polymer composites. *Nature* 409, 794-797 (2001). One possible explanation for the surprisingly rapid restoration of conductivity is that the time scales for mass transport of Ga—In via capillary action from the location of the ruptured capsules to the site of damage is much smaller than that of mass transport of polymerization reagents through a polymer matrix.

In contrast, a control specimen containing no microcapsules (neat epoxy dielectric layer) showed no recovery even after unloading (FIG. 4B). This result was also observed for different control specimens, including specimens that contained solid Ga particles in the dielectric layer, and specimens that contained solid glass beads in the dielectric layer.

FIG. 4C depicts a graph of the percentage of specimens healed. None of the control specimens (square data points at bottom) showed significant conductivity recovery, whether the specimens were neat epoxy, epoxy containing glass beads, or epoxy containing solid Ga particles. For specimens that included ~200 micrometer microcapsules containing Ga—In liquid (circular data points), the percentage of recovered specimens was proportional to the volume fraction of capsules included in the dielectric epoxy layer. At the maximum volume fraction tested (0.16), 90% (9/10) of the samples recovered conductivity. For the specimens that healed, nearly full recovery of conductance was achieved ($\eta_c$=99%), independent of microcapsule volume fraction.

Remarkably, all specimens that included ~10 micrometer microcapsules containing Ga—In liquid showed substantially complete healing (square data point at top). This recovery was observed for specimens having a microcapsule volume fraction of only 0.007. The recovery was observed for all 7 specimens, and the recovery efficiency was high ($\eta_c$=98%). One possible explanation for this surprisingly strong recovery is that increasing capsule volume fraction or decreasing capsule size increases the probability that the propagating crack will intersect and rupture a capsule. When the crack intersects a capsule, the released liquid metal forms a conductive pathway and healing occurs with high efficiency.

In another example (i.e. FIG. 1B), an autonomic conductivity restoration system includes a solid conductor, a solid polymer matrix on the conductor, and a plurality of particles in the matrix. The solid conductor has a first end, a second end, and a first conductivity between the first and second ends. The particles include a plurality of conductive microparticles. When a crack forms between the first and second ends of the conductor and in the matrix, at least a portion of the conductive microparticles is released. The released conductive microparticles contact the conductor and form a restored conductor having a second conductivity. Preferably the second conductivity is at least 90% of the first conductivity.

The solid conductor and the solid polymer matrix may be as described above. The first and second conductivities may be determined as outlined above. In an autonomic conductivity restoration system based on encapsulated conductive microparticles, restoration of conductivity may be accomplished by the release and transport of the conductive microparticles to the site of damage.

The conductive microparticles may be any microparticles or nanoparticles that together are electrically conductive. The conductive microparticles may include a conductive material, such as a conductive metal, carbon or a conducting polymer. The conductive microparticles may include a material that is an insulator or a dielectric, but that is covered with a conductive material. Examples of conductive microparticles include carbon nanotubes, graphene, carbon black, graphite microparticles, gold nanoparticles, silver microparticles, silicon microparticles, and titanium oxide ($TiO_2$) microparticles.

The conductive microparticles may include other ingredients, such as a stabilizer. Examples of stabilizers include surfactants and polymers. In one example, the conductive polymer poly(3-hexylthiophene) has been used to stabilize carbon nanotubes, substantially preventing the formation of bundles of the nanotubes.

In an autonomic conductivity restoration system based on particles containing a plurality of conductive microparticles, restoration of conductivity may be accomplished by the release and transport of the conductive microparticles to the site of damage. Transport of the conductive microparticles may be provided by solvent present with the conductive microparticles in a capsule. Transport of the conductive microparticles also may be provided by solvent present in a plurality of capsules in the system, where rupture of the capsules releases the solvent, which dissolves an encapsulant material containing the conductive microparticles. The conductive microparticles may form a percolating conductive network that traverses the crack in the solid conductor.

The autonomic conductivity restoration system represented schematically in FIGS. 2A-2C also can represent a system 200 that includes a solid conductor 210 (optionally on substrate 240), a solid polymer matrix 220 on the conductor, and a plurality of particles 230 in the matrix. When an electric potential is applied between the first and second ends (214, 214; FIG. 2A), an electric current flows in the conductor having a first conductivity and can provide electric power to an optional electric device 250. After the solid conductor has been damaged by a crack 260 (FIG. 2B), the contents of a portion of the capsules 230 are released into the crack 260. Once the contents have been released and traverse the crack 260 (FIG. 2C), the damaged solid conductor and the conductive material 270 formed from the contents of the portion of the particles form a restored conductor 280.

The particles 230 may include capsules containing the conductive microparticles and a solvent. In this example, when a crack forms between the first and second ends of the conductor and in the matrix, at least a portion of the capsules is ruptured, and the conductive microparticles and the solvent are released to contact the conductor. The capsules also may be as described above, except that the interior volume of the capsules contains conductive microparticles.

The capsules that contain the conductive microparticles and a solvent may be made by treating the conductive microparticles with a surfactant, and combining the treated microparticles with an oil phase. The oil phase is combined with an aqueous phase to form an emulsion, and a polymerization is carried out in the aqueous phase to form capsule walls enclosing the oil phase droplets. This technique can provide for conductive microparticles that are present in the capsule core as free-flowing particles, rather than being embedded in the capsule shell wall.

Figure 5A:
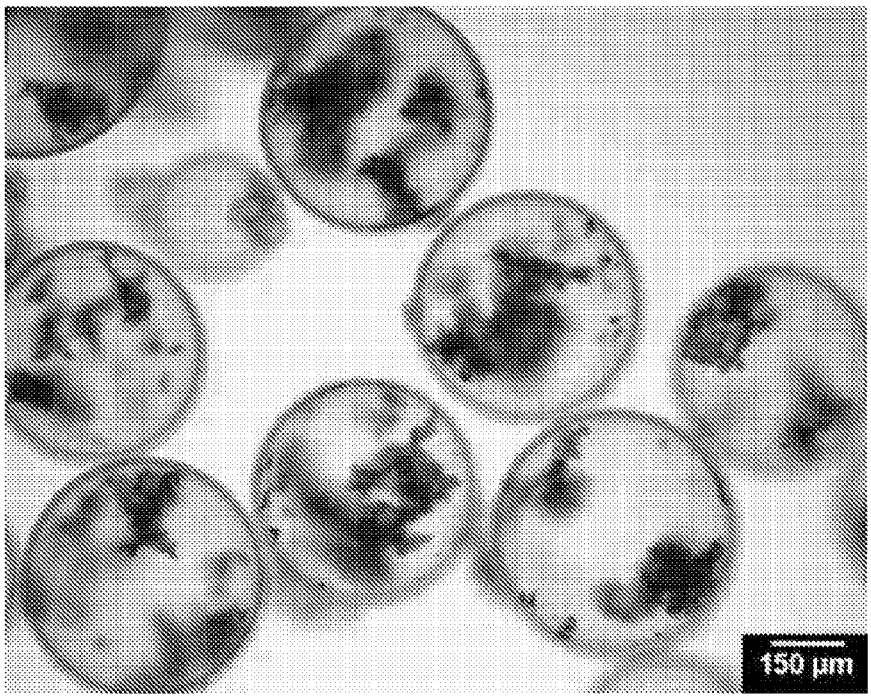
FIG. 5A depicts an optical micrograph of capsules containing single-walled nanotubes (SWNTs).
Figure 5B:
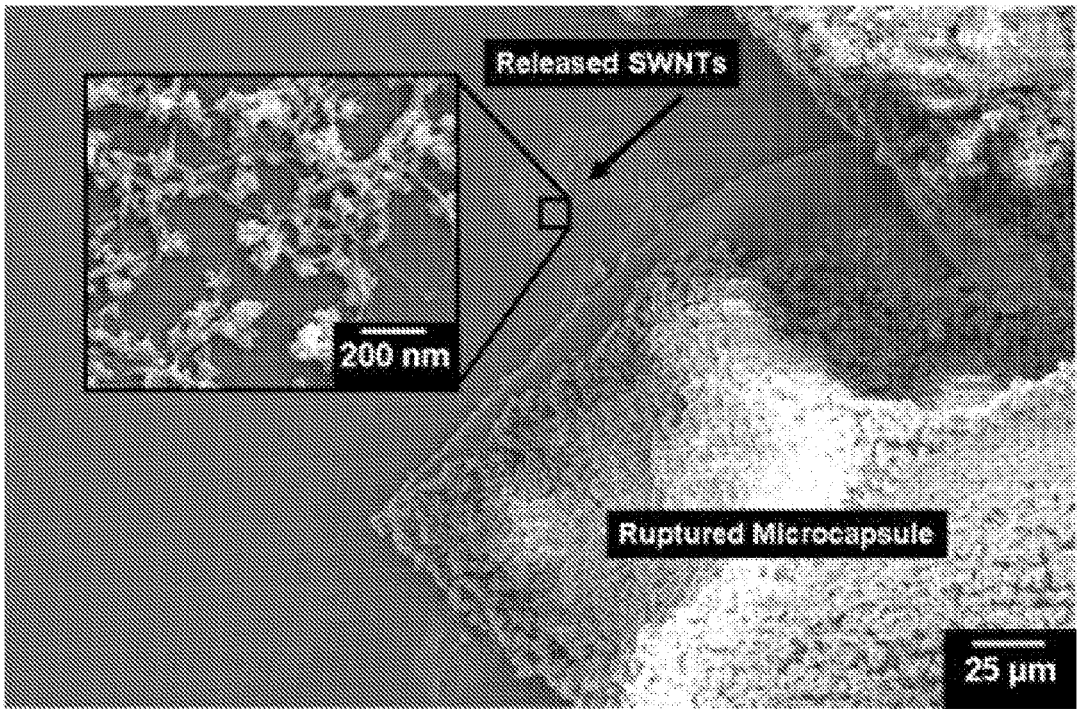
FIG. 5B depicts a scanning electron microscopy (SEM) image of ruptured capsules that contained SWNTs.

FIG. 5A depicts an optical micrograph of capsules containing single-walled nanotubes (SWNTs) (0.05 wt %) suspended in the solvent ethyl phenylacetate (EPA), where the encapsulated bundles of SWNTs are visible through the capsule wall. When a DC electric field was applied to individual capsules containing SWNTs, the value of the measured electric current increased as the concentration of SWNTs in the capsules increased. FIG. 5B depicts an SEM image of the ruptured capsules, including an image of the bundles of released SWNTs, which formed a percolating conductive network.

In an example of an autonomic conductivity restoration system based on capsules containing carbon nanotubes and/or graphene flakes, capsules having an average diameter of 125-180 micrometers and containing carbon nanotubes and/or graphene stabilized with poly(3-hexylthiophene) and containing dichlorobenzene as a solvent were present in an epoxy matrix on a gold conductor. When a gap was made in the gold conductor line via mechanical cracking, conductivity was restored to the conductor by the formation of a restored conductor including the nanotubes. In contrast, conductivity was not restored when the epoxy on the gold conductor included only capsules (average diameter of 125-180 micrometers) containing chlorobenzene solvent but no conductive microparticles.

Figure 6A:
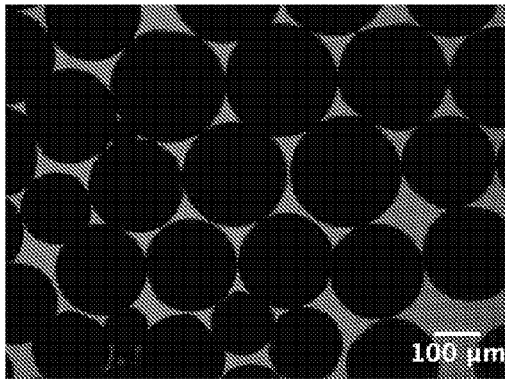
FIG. 6A depicts an optical micrograph of capsules containing carbon black microparticles in the core.
Figure 6B:
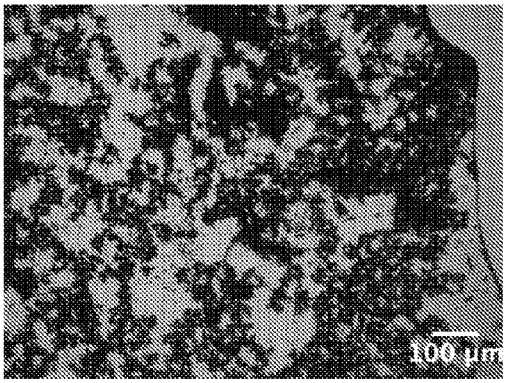
FIG. 6B depicts an optical micrograph of the ruptured capsules of FIG. 6A.

FIG. 6A depicts an optical micrograph of UF capsules containing carbon black microparticles in the core. FIG. 6B depicts an optical micrograph of the ruptured capsules, where the carbon black microparticles have formed a conductive film once the solvent had evaporated.

Figure 7A:
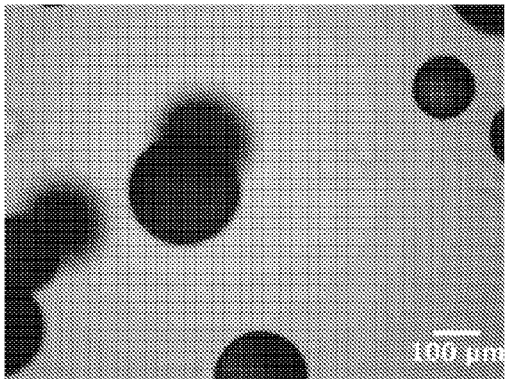
FIG. 7A depicts an optical micrograph of capsules containing $TiO_2$ microparticles in the core.
Figure 7B:
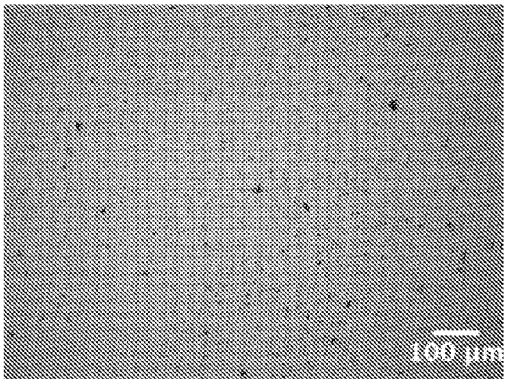
FIG. 7B depicts an optical micrograph of the ruptured capsules of FIG. 7A.

FIG. 7A depicts an optical micrograph of UF capsules containing $TiO_2$ microparticles in the core. FIG. 7B depicts an optical micrograph of the ruptured capsules, where the $TiO_2$ microparticles have formed a semiconductive film once the solvent had evaporated.

Figure 8A:
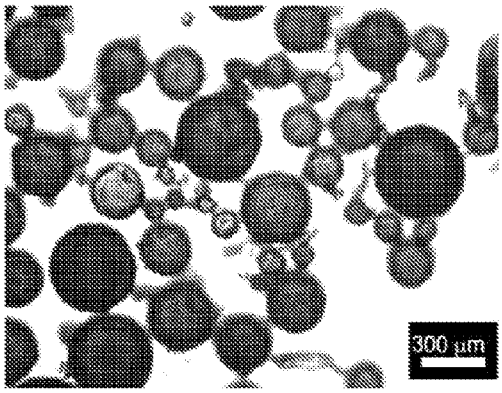
FIG. 8A depicts an optical micrograph of capsules containing alkylthiol-stabilized gold nanoparticles and toluene.
Figure 8B:
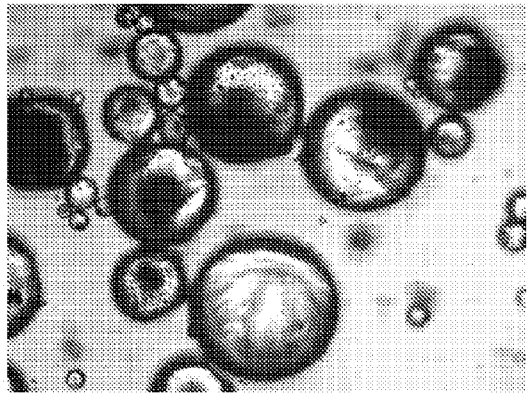
FIG. 8B depicts an optical micrograph of capsules containing silver microparticles and toluene.

FIG. 8A depicts an optical micrograph of UF capsules containing alkylthiol-stabilized gold nanoparticles and toluene. FIG. 8B depicts an optical micrograph of UF capsules containing silver microparticles and toluene. The contents of each of these types of capsules restored conductivity when deposited on a 5 micrometer gap in a gold conductor line. See Example 7, below, for experimental details.

The particles 230 may include solid particles that include the conductive microparticles and an encapsulant. In this example, the system further includes a plurality of capsules containing a solvent for the encapsulant. When a crack forms between the first and second ends of the conductor and in the matrix, at least a portion of the capsules is ruptured and releases the solvent, and the solvent in turn dissolves at least a portion of the encapsulant to release the conductive microparticles.

Solid particles that contain the conductive microparticles and an encapsulant material may be made by a variety of techniques, and from a variety of materials. For example, the conductive microparticles may be dispersed into a liquid containing the encapsulant, followed by solidification of the mixture of encapsulant and the microparticles. The resulting particles preferably have an average diameter of at most 500 micrometers. The encapsulant preferably is a solid at room temperature, and dissolves or swells in the solvent contained in the capsules in the system.

Capsules containing a solvent for the encapsulant may be made by methods described in U.S. Patent Application Publication 2011/0039980, published Feb. 17, 2011 with inventors Caruso et al., paragraphs 55-61 of which are incorporated by reference. The capsules may include an aprotic solvent, a protic solvent, or a mixture of these. Examples of aprotic solvents include hydrocarbons, such as cyclohexane; aromatic hydrocarbons, such as toluene and xylenes; halogenated hydrocarbons, such as dichloromethane; halogenated aromatic hydrocarbons, such as chlorobenzene and dichlorobenzene; substituted aromatic solvents, such as nitrobenzene; ethers, such as tetrahydrofuran (THF) and dioxane; ketones, such as acetone and methyl ethyl ketone; esters, such as ethyl acetate, hexyl acetate, ethyl phenylacetate (EPA) and phenylacetate (PA); tertiary amides, such as dimethyl acetamide (DMA), dimethyl formamide (DMF) and N-methyl pyrrolidine (NMP); nitriles, such as acetonitrile; and sulfoxides, such as dimethyl sulfoxide (DMSO). Examples of protic solvents include water; alcohols, such as ethanol, isopropanol, butanol, cyclohexanol, and glycols; and primary and secondary amides, such as acetamide and formamide.

Figure 9A:
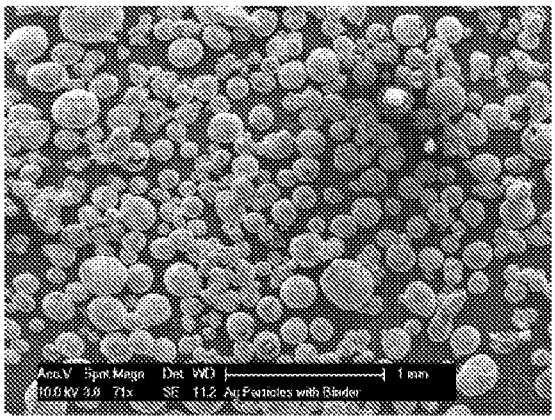
FIGS. 9A-9B depict SEM images of solid particles containing silver microparticles and an acrylic encapsulant.
Figure 9B:
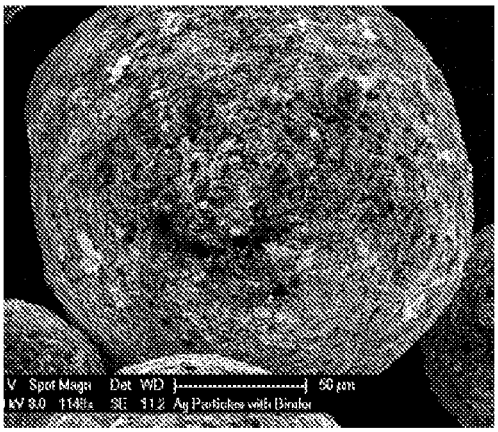
Figure 9C:
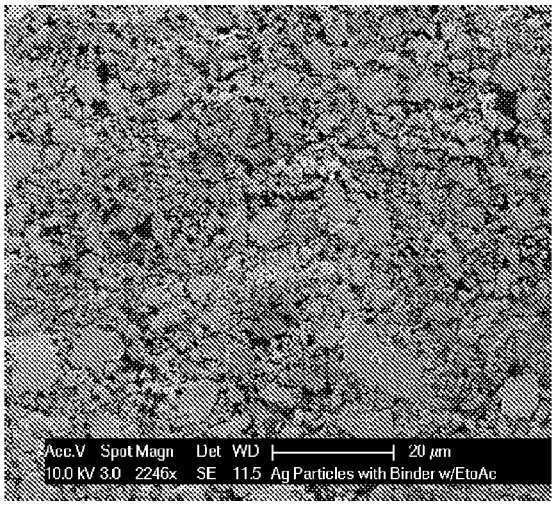
FIG. 9C depicts an SEM image of a film formed after the particles of FIG. 9A were contacted with ethyl acetate solvent to dissolve the acrylic encapsulant.

FIG. 9A depicts an SEM image of solid particles containing silver microparticles and an acrylic encapsulant. FIG. 9B depicts an SEM image of one of the particles of FIG. 9A, in which the silver microparticles were more distinctly visible. FIG. 9C depicts an SEM image of a film formed after the particles of FIG. 9A were contacted with ethyl acetate solvent to dissolve the acrylic encapsulant. Removal of the solvent provided a conductive network held together by the acrylic polymer In another example (i.e. FIG. 1C), an autonomic conductivity restoration system includes a solid conductor, a solid polymer matrix on the conductor, and a plurality of particles in the matrix. The solid conductor has a first end, a second end, and a first conductivity between the first and second ends. The particles include a conductive material forming agent. When a crack forms between the first and second ends of the conductor and in the matrix, at least a portion of the conductive material forming agent is released into the crack. The conductive material forming agent contacts the conductor and forms a restored conductor having a second conductivity. Preferably the second conductivity is at least 90% of the first conductivity.

The conductive material forming agent may be any substance or combination of substances that can form a conductive material. In one example, the conductive material forming agent includes two separate substances that form a conductive material when combined. In another example, the conductive material forming agent includes a polymerizer that can form a conductive polymer.

In an example of a conductive material forming agent that includes two separate substances that form a conductive material when combined, the particles of the autonomic conductivity restoration system may be two different sets of capsules. One set of capsules may include a first reactant that is a donor of a charge-transfer substance, and a second set of capsules may include a second reactant that is a corresponding acceptor of a charge-transfer substance. Examples of charge-transfer donors include tetrathiafulvalene (TTF), 4-dimethylamino-phenylacetylene (DAP), bis(4-dimethylamino-phenylacetylene) (BIS-DAP), bis(dimethylaminophenyl)acetylene (BAT), anisole, and derivatives thereof, including other alkynes that are connected to electron-donating groups. Examples of charge-transfer acceptors include tetracyanoquinodimethane (TCNQ), tetracyanoethylene (TCNE), quinones, and derivatives thereof. The combination of a charge-transfer donor and a charge-transfer acceptor can form a charge-transfer substance having an electrical conductivity. The charge-transfer substance may be a charge-transfer salt, a charge-transfer molecule or a charge-transfer complex.

Figure 10:
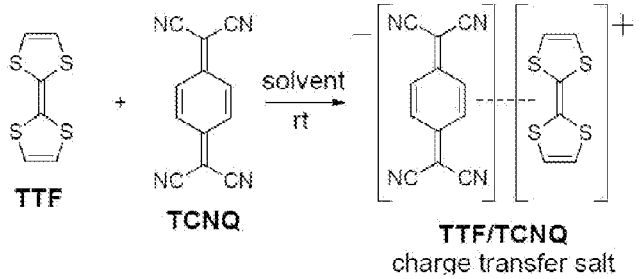
FIG. 10 illustrates a reaction scheme for the reaction of the charge-transfer donor TTF with the charge-transfer acceptor TCNQ.
Figure 11A:
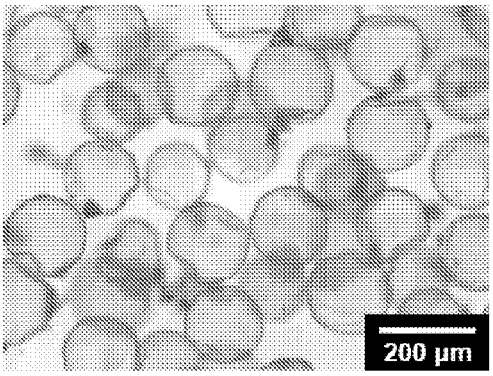
FIG. 11A depicts an optical microscopy image of capsules containing the charge-transfer donor TTF in phenyl acetate (PA).
Figure 11B:
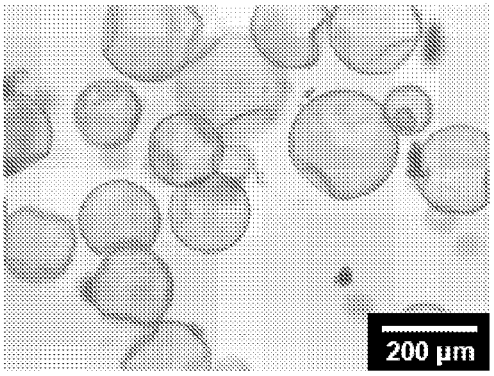
FIG. 11B depicts an optical microscopy image of capsules containing the charge-transfer acceptor TCNQ in PA.

FIG. 10 illustrates a reaction scheme for an example in which the first reactant is the charge-transfer donor TTF, and the second reactant is charge-transfer acceptor TCNQ. The product of the first and second reactants is a charge-transfer salt. FIG. 11A depicts an optical microscopy image of the poly(urea-formaldehyde) capsules containing the charge-transfer donor TTF in PA. FIG. 11B depicts an optical microscopy image of the poly(urea-formaldehyde) capsules containing the charge-transfer acceptor TCNQ in PA. The contents of capsules containing TTF and capsules containing TCNQ, when ruptured together on a 5 micrometer gap in a gold conductor line, restored conductivity to the conductor. In contrast, when only one type of capsule was ruptured on the gap, no conductivity was restored to the conductor.

In an example of a conductive material forming agent that includes a polymerizer that can form a conductive polymer, the polymerizer may be a monomer, a prepolymer, or a functionalized polymer having two or more reactive groups. Examples of polymerizers include polymerizers for polythiophene, polypyrrole, polyaniline and poly(phenylene vinylene).

Figure 12A:
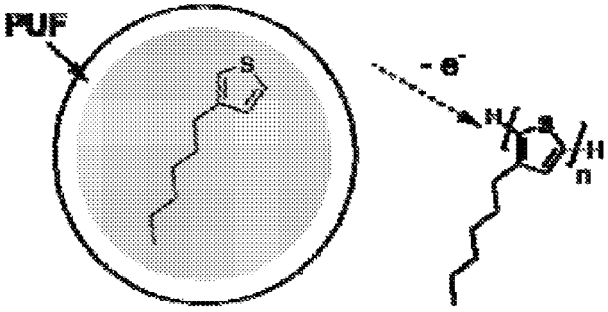
FIG. 12A illustrates a scheme for the formation of the conducting polymer poly(3-hexylthiophene) from 3-hexylthiophene released from a capsule.
Figure 12B:
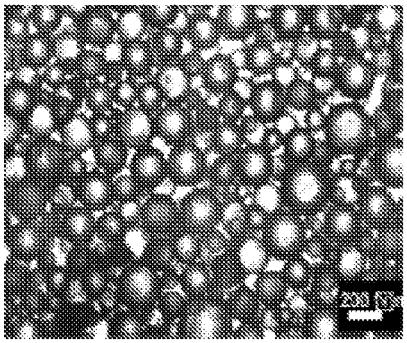
FIG. 12B depicts an optical microscopy image of capsules containing 3-hexylthiophene.

FIG. 12A illustrates a scheme for an example in which a capsule includes 3-hexylthiophene, which can form the conducting polymer poly(3-hexylthiophene) upon release from the capsule. FIG. 12B depicts an optical microscopy image of UF capsules containing 3-hexylthiophene.

The following examples are provided to illustrate one or more preferred embodiments of the invention. Numerous variations can be made to the following examples that lie within the scope of the invention.

EXAMPLES

Example 1

Formation of Microcapsules Containing Conductive Fluid

A liquid Gallium-Indium alloy was prepared from approximately 77 wt % Ga (GalliumSource, LLC) and approximately 23 wt % In (Strem Chemicals). The alloy was encapsulated via an in situ reaction of urea and formaldehyde. An aqueous mixture of 20.0 g water and 5.00 g ethylene maleic anhydride copolymer (EMA, 2.5% wt/vol solution) was prepared, and to this mixture was added the ingredients for forming a capsule wall: 0.50 g urea, 0.05 g resorcinol, and 0.05 g ammonium chloride. The pH was adjusted to 3.50 via addition of 5 wt % NaOH solution, and approximately 36 g of liquid metal was added. The combined mixture was stirred on a temperature-controlled hotplate. The temperature was increased to 55° C., and held for 4 h. After the encapsulation was complete, the capsules were washed 6 times with 20 mL deionized $H_20$ and then 6 times with 20 mL ethanol. Excess ethanol was removed, and the resulting capsule slurry was frozen in liquid nitrogen and lyophilized to obtain a dry powder.

Figure 13:
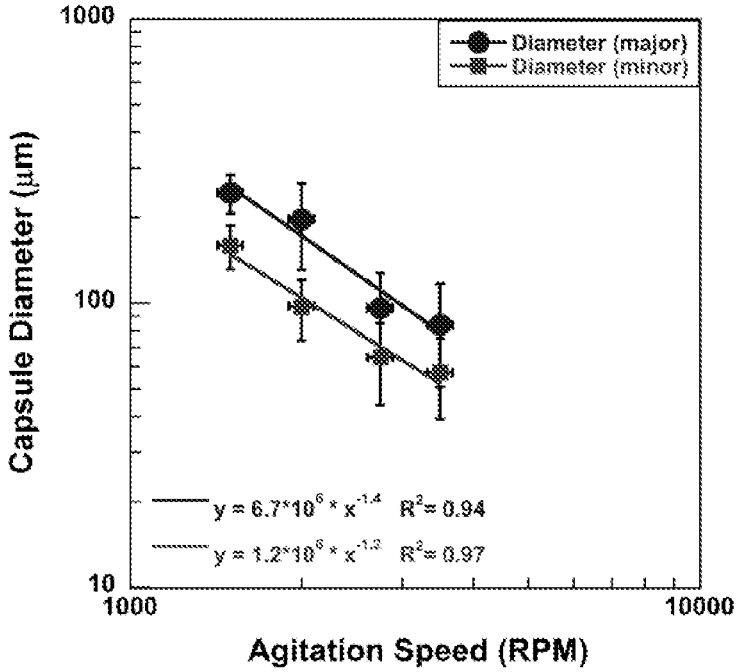
FIG. 13 depicts a graph of capsule size distributions.

FIG. 13 depicts a graph of capsule size distributions. The graph is a logarithmic plot of microcapsule mean diameter, major and minor, measured for capsules prepared at various agitation rates. Vertical error bars represent the standard deviation of the observed mean.

Example 2

Preparation of Patterned Gold Specimens

Glass substrates (12-mm×75-mm×1-mm) were prepared using hexamethyldisilazane (HMDS) vapor primer to increase adhesion of photoresist. We spun AZ5214E photoresist (AZ Electronic Materials) onto substrates at 3000 rpm for 30 s. Then specimens were soft baked at 95° C. for 60 s on a hotplate yielding a thickness of 2.5 μm. Next the specimens were aligned with the appropriate quartz mask (clear in areas where metallic pattern is desired, dark elsewhere) and exposed on a Karl Suss MJB3 mask aligner at 8.5 mW $cm^{-2}$ intensity I-line (=635 nm) for 10 s. After exposure, specimens rested for 5 min for optimal resolution. Next the specimens were immersed in a mixture of AZ351 developer 1:4 parts deionized water for 20 s, and then rinsed in deionized water and dried under a stream of $N_2$. After this step, the specimen had no photoresist left in the areas where the metal would deposit on the substrate. A hard bake of 3 min at 110° C. was applied to the specimens to reduce outgassing during electron beam deposition of 10-nm Cr followed by 100-nm Au over the entire surface at a vacuum greater than $10^{-6}$ Torr at a rate of 1-2 Å/s. Then the specimens were submerged in acetone for 1 h to strip the remaining photoresist taking the unwanted Cr—Au pattern with it. Specimens were rinsed in isopropyl alcohol, DI water, blown dry and baked to remove residual solvents. All steps were completed in grade 1000 clean room facilities at Frederick Seitz Material Research Laboratory at the University of Illinois at Urbana-Champaign.

The resulting Au/Cr film patterns included 5 electrically isolated Au/Cr lines that spanned the length of the glass slide. The lines were spaced 1.0 mm apart and had a line width of 1.5 mm. The center Au/Cr line was monitored via the Wheatstone Bridge voltage (see Example 5, below), and the other lines were used to test for internal short circuits after mechanical testing. The crack separation at the Au/Cr line after unloading was approximately 5-10 μm.

Example 3

Preparation of Specimens for Conductivity Restoration Testing

Four-point bend sandwich specimens were prepared using Epon 828-diethylenetriamine (DETA) epoxy (Miller-Stephenson), Ga—In capsules, glass substrates, notched glass substrates, glass spacer beads (180-250 μm), and acrylic substrates (McMaster-Carr). Epoxy was prepared as 12 pph DETA mixed with EPON 828 (DGEBA) resin, and was degassed for 15 min. Plain epoxy was placed on the acrylic backing and spread evenly across the surface. Glass spacer beads (125-180-μm diameter) were added to each epoxy layer to achieve uniform thickness. A glass substrate with conductive Au lines was placed on top of the epoxy layer with the conductive pattern away from the epoxy. Ga—In capsules (ca. 200-μm diameter) were added via manual stirring into the epoxy as a dried powder and manually spread onto the Au pattern. Ga—In capsules (ca. 10-μm mean diameter) were mask-patterned directly onto the Au pattern from ethanol and the dried capsules were manually coated with an epoxy layer. Finally, a notched glass substrate, treated with (3-trimethoxysilylpropyl)-diethylenetriamine (Gelest Inc.) to improve bonding with the epoxy, was added to the top with the notch opening facing away from the epoxy. The specimens were then cured for 24 h at room temperature.

The resulting specimens had overall dimensions of 12.0 mm wide×75.0-mm long×4.0 mm thick. The notched glass and epoxy/microcapsule layers were 60 mm long to accommodate electrical contacts on either end of the Au lines. Specimen layer thickness dimensions were 1.5 mm acrylic, 250 μm epoxy dielectric (Epon 828-DETA), 1.0 mm glass, 10 nm Cr, 100 nm Au, 250 μm epoxy dielectric and liquid metal capsules, and 1.0 mm of glass treated with (3-trimethoxysilylpropyl)diethylenetriamine, with a central rounded notch ca. 500 μm deep.

After epoxy curing, lead wires were attached to the conductive pattern via first soldering to a Cu pad glued to the acrylic substrate and then addition of a conductive silver paint pathway from the Cu pad to the conductive Au line.

Example 4

Introduction of Crack to Specimens

Four-point bend loading of layered materials is often performed to determine interfacial adhesive fracture properties by an initially Mode I crack that propagates from a notch and then turns to delaminate along a weaker interface. A four-point bend loading was selected for use with the specimens for three main reasons: 1) the Mode I crack reliably broke the metal line; 2) the Mode I crack also broke the microcapsules that lay in the crack path; and 3) the crack then delaminated at a subsequent interface such that the specimen did not break into two separate pieces. The load-displacement curves generally showed the linear response of the specimen until a sudden drop in load corresponding to the Mode I crack propagation, and then showed a plateau load with continued displacement of the inner loading pins corresponding to delamination between two interfaces.

Specimens were subjected to four-point bend loading using a custom four-point bend loading frame that included a base with adjustable pin spacing (nominally 55 mm), a top fixture with 16 mm pin spacing, a 45 N load cell (Futek LSB200), an amplifier (Omega DP25B-S-A), and a linear actuator (Physik Instrumente M-230.25 S) for displacement of the top fixture. LabVIEW 2009 was used for actuator control and load data acquisition.

Example 5

Conductivity Restoration Testing

The four-point bend specimens of Example 2 were individually used as one resistor in an unbalanced constant voltage Wheatstone Bridge circuit. The voltage source was a BK Precision DC Power Supply (model 1710). The bridge voltage and voltage source were monitored either by LabVIEW DAQ or a digital oscilloscope (LeCroy LC584A).

Figure 14:
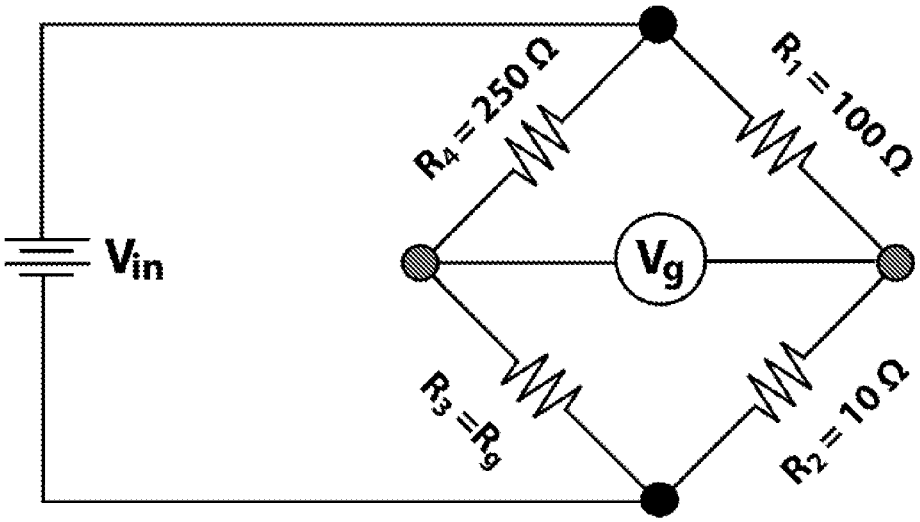
FIG. 14 is a schematic depiction of an unbalanced constant voltage Wheatstone Bridge circuit used for measuring the conductivity of specimens.

FIG. 14 is a schematic depiction of an unbalanced constant voltage Wheatstone Bridge circuit used for measuring the conductivity of specimens. The circuit included a fracture specimen with a metal thin film line ($R_g$); three standard resistors with 10-W power ratings and nominally 100-Ω ($R_1$), 10-Ω ($R_2$), and 250-Ω ($R_4$) resistance; a voltage source ($V_{in}$) with up to 10-V output; and a bridge voltage ($V_g$). The bridge voltage for this circuit was $$V_g = V_{in} \cdot [(R_1/(R_1+R_2)) - (R_4/(R_g+R_4))]$$

The bridge voltage for a broken sample ($V_\infty$) is defined as the bridge voltage, $V_g$, as the resistance of R3 approaches infinity, and is given in terms of the other constants as:

$$V_\infty = \frac{V_{in} \cdot R_1}{R_1 + R_2}$$

Autonomic restoration is quantified in terms of $V_{norm}$, which is a function of the healed bridge voltage ($V_h$), the original bridge voltage ($V_g^o$), and $V_\infty$ as:

$$V_{norm} = \frac{V_h - V_\infty}{V_g^o - V_\infty} - \frac{R_g^o + R_4}{R_h + R_4}$$

The monitored bridge voltage of this circuit is sensitive to changes in resistance in the conductive Au line, providing excellent resolution for small resistance changes with manageable bridge voltage range between the virgin and broken metal line cases.

All load and displacement data and voltage data obtained from the LabVIEW DAQ were used without smoothing or reduction techniques. Raw oscilloscope data taken at a rate of 1 MHz were smoothed by averaging 4 data points (4-μs time equivalent) within no more than four data points of a discontinuity. Micro-CT data was collected on an XRadia MicroXCT-200, imported via Amira software, and stylized with Maya software. Some visualized capsules were removed from the field of view to allow for an unimpeded view of the metal deposited in the crack plane. Table 1 lists the conductivity restoration results for various specimens.

TABLE 1

Summary of results for conductivity restoration testing

| Specimen type | Additive | Volume fraction additive | Restoration efficiency | % Specimens Healed | Number of specimens |
|---|---|---|---|---|---|
| Control | — | — | — | 0 | 15 |
| Control | Glass spheres | — | — | 0 | 9 |
| Control | Solid Ga particles | 0.13 | — | 0 | 10 |
| Autonomous | 200 μm capsules | 0.05 | 99.7 | 20 | 10 |
| Autonomous | 200 μm capsules | 0.10 | 99.7 | 63 | 8 |
| Autonomous | 200 μm capsules | 0.13 | 99.1 | 83 | 12 |
| Autonomous | 200 μm capsules | 0.16 | 99.0 | 90 | 10 |
| Autonomous | 10 μm capsules | 0.007 | 98.1 | 100 | 7 |

Example 6

Formation of Capsules Containing Conductive Microparticles

Conductive microparticles were prepared for encapsulation with a surface treatment. Approximately 3 g of carbon black particles were mixed with 50-60 mL solvent (i.e. phenyl acetate (PA)), 0-10 g binder, 0.3 g Span 85 surfactant, and optionally a polyurethane prepolymer to form an oil mixture. The amount of solvent and binder together accounted for approximately 60% of the mass of the oil mixture. The presence of the polyurethane prepolymer can increase the robustness of the resulting capsules. The oil mixture was sonicated for 20 minutes to provide for a substantially uniform adsorption of the surfactant on the conductive microparticles.

Capsules containing the conductive microparticles were prepared via an in situ reaction of urea and formaldehyde, using techniques similar to those of Example 1. An aqueous mixture of 200 mL water and 50 mL of a 2.5% wt/vol solution of EMA was prepared, and to this mixture was added the ingredients for forming a capsule wall: 5.0 g urea, 0.5 g resorcinol, and 0.5 g ammonium chloride. The pH was adjusted to 3.5 via addition of a NaOH solution. The oil mixture and the aqueous mixture were combined, and an emulsion was formed by stirring and/or sonication, depending on the desired size of the capsules. Once the emulsion was formed, 12.67 g formalin was added, and the temperature was increased to 55° C. at 1° C./min, and held for 4 h. After the encapsulation was complete, the capsules were washed 6 times with 20 mL deionized water and then 6 times with 20 mL ethanol. Excess ethanol was removed, and the resulting capsule slurry was frozen in liquid nitrogen and lyophilized to obtain a dry powder.

Example 7

Conductivity Restoration Testing For Conductive Microparticles

Figure 15:
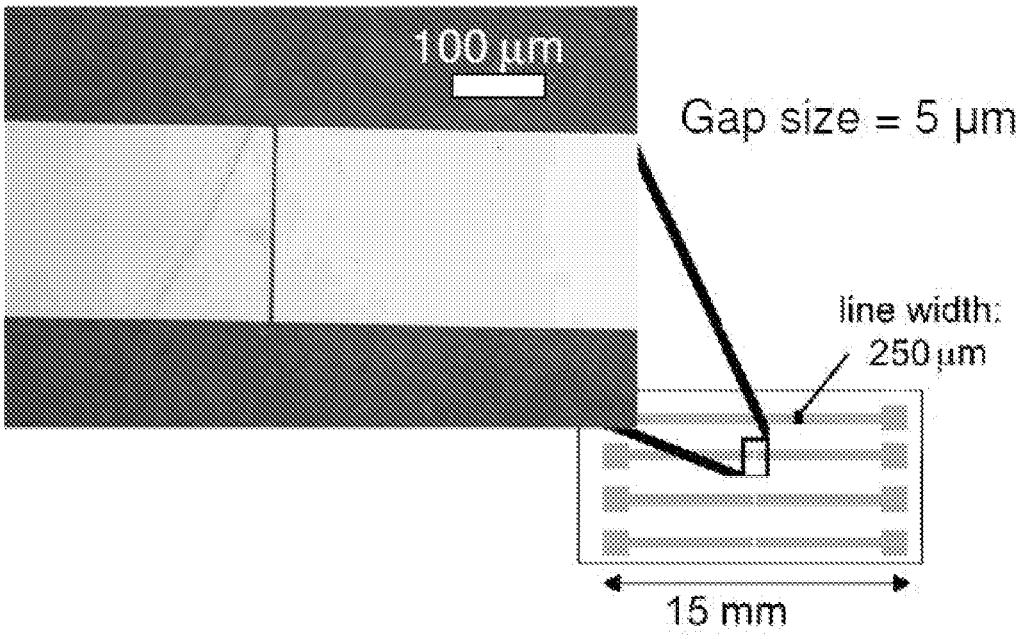
FIG. 15 is a schematic representation of conductive lines used for measuring the restoration of conductivity provided by rupture of capsules containing conductive microparticles.

FIG. 15 is a schematic representation of conductive lines used for measuring the restoration of conductivity provided by rupture of capsules containing conductive microparticles. Gold conductor lines having a line width of 250 micrometers and a length of 15 mm were scratched to provide a 5 micrometer gap in the conductor. The optical micrograph in FIG. X-3 is a magnified image of the gap. An applied voltage was applied from negative to positive, and the resulting electric current was measured. This measurement was carried out for an unbroken conductor, for a conductor having a bare 5 micrometer gap, and for a conductor having a 5 micrometer gap covered with the contents of ruptured capsules.

Example 8

Formation of Particles Containing Conductive Microparticles and an Encapsulant

Particles containing conductive microparticles were formed by combining the conductive microparticles with an encapsulant. A microparticle mixture was formed by combining silver nanoparticles with an acrylic polymer binder in ethyl acetate solvent. An aqueous mixture was formed by combining deionized water, glycerol and a 2.5% wt/vol solution of EMA. The relative amounts of water, glycerol and EMA solution were varied to match the viscosity of the microparticle mixture, while maintaining the combined amounts of deionized water and glycerol at approximately 15 mL. The microparticle mixture and the aqueous mixture were combined, and an emulsion was formed by stirring and/or sonication, depending on the desired size of the particles. Once the emulsion was formed, the temperature was increased to 70° C. at 1° C./min, and held for 4 h. The resulting particles were washed with deionized water.

In ambient conditions, paraffin wax and Grubbs-Love Catalyst were combined in a vial. A solution of water, poly (ethylene-co-maleic anhydride) and octanol was placed in a beaker, placed in an 82° C. water bath, and stirred with a mechanical stirrer at 900 RPM. The vial containing the wax and the catalyst was submerged in the same 82° C. water bath. After 10 min, the wax had melted and the aqueous solution had reached 65-70° C. The vial with the molten wax was shaken to disperse the catalyst. The vial was then opened (in air), and the wax was poured into the aqueous solution. After 2 min, water at 0° C. was quickly added, and the stirring was stopped. The particles were collected by filtration and dried under vacuum.

While various embodiments of the invention have been described, it will be apparent to those of ordinary skill in the art that other embodiments and implementations are possible within the scope of the invention. Accordingly, the invention is not to be restricted except in light of the attached claims and their equivalents.

What is claimed is:

1. An autonomic conductivity restoration system, comprising:

a solid conductor having a first end, a second end, and a first conductivity between the first and second ends;

a solid polymer matrix on the conductor; and a plurality of capsules in the matrix, the capsules comprising a conductive fluid and a capsule wall;

where, when a crack forms between the first and second ends of the conductor and in the matrix, at least a portion of the capsules is ruptured, and the conductive fluid contacts the conductor and forms a restored conductor having a second conductivity that is at least 90% of the first conductivity.

2. The system of claim 1, where the second conductivity is at least 95% of the first conductivity.

3. The system of claim 1, where the second conductivity is at least 99% of the first conductivity.

4. The system of claim 1, where the second conductivity is equal to the first conductivity.

5. The system of claim 1, where the time between the formation of the crack and the formation of the restored conductor is at most 0.1 second.

6. The system of claim 1, where the time between the formation of the crack and the formation of the restored conductor is at most 0.01 second.

7. The system of claim 1, where the time between the formation of the crack and the formation of the restored conductor is at most 0.001 second.

8. The system of claim 1, where the solid conductor is selected from the group consisting of gold, platinum and copper.

9. The system of claim 1, where the conductive fluid comprises a liquid metal selected from the group consisting of gallium, mercury, or a mixture of at least two of gallium, indium, tin, lead, bismuth, cadmium, mercury, antimony, silver, copper, and gold.

10. An autonomic conductivity restoration system, comprising:

a solid conductor having a first end, a second end, and a first conductivity between the first and second ends;

a solid polymer matrix on the conductor; and a plurality of capsules in the matrix, the capsules comprising a plurality of conductive microparticles and a capsule wall;

where, when a crack forms between the first and second ends of the conductor and in the matrix, at least a portion of the conductive microparticles is released, and the released conductive microparticles contact the conductor and form a restored conductor.

11. The system of claim 10, where the capsules further comprise a solvent, where, when a crack forms between the first and second ends of the conductor and in the matrix, at least a portion of the capsules is ruptured, and the conductive microparticles and the solvent are released to contact the conductor.

12. The system of claim 10, where the particles comprise solid particles comprising the conductive microparticles and an encapsulant;

the system further comprises a plurality of capsules comprising a solvent for the encapsulant;

where, when a crack forms between the first and second ends of the conductor and in the matrix, at least a portion of the capsules is ruptured and releases the solvent, and the solvent dissolves at least a portion of the encapsulant to release the conductive microparticles.

13. The system of claim 10, where the solid conductor is selected from the group consisting of gold, platinum and copper.

14. The system of claim 10, where the conductive microparticles are selected from the group consisting of carbon nanotubes, carbon black, graphite microparticles, gold nanoparticles, silver microparticles, silicon microparticles, and titanium oxide microparticles.

15. The system of claim 10, where the conductive microparticles form a percolating conductive network when released.

16. An autonomic conductivity restoration system, comprising:

a solid conductor having a first end, a second end, and a first conductivity between the first and second ends;

a solid polymer matrix on the conductor; and a plurality of capsules in the matrix, the capsules comprising a conductive material forming agent and a capsule wall;

where, when a crack forms between the first and second ends of the conductor and in the matrix, at least a portion of the conductive material forming agent is released, and the released conductive material forming agent contacts the conductor and forms a restored conductor.

17. The system of claim 16, where the plurality of capsules comprises a first plurality of capsules and a second plurality of capsules;

the first plurality of capsules comprising a charge-transfer donor, and the second plurality of capsules comprising a charge-transfer acceptor.

18. The system of claim 17, where the charge-transfer donor is selected from tetrathiafulvalene (TTF), 4-dimethylamino-phenylacetylene (DAP), bis(4-dimethylamino-phenylacetylene) (BIS-DAP), bis(dimethylaminophenyl)acetylene (BAT), and anisole, and the charge-transfer acceptor is selected from tetracyanoquinodimethane (TCNQ), tetracyanoethylene (TCNE), and quinones.

19. The system of claim 16, where the plurality of capsules comprises a polymerizer for a conducting polymer.

20. The system of claim 19, where the polymerizer comprises 3-hexylthiophene.

* * * * *